US008277763B2

(12) United States Patent
Steinmann et al.

(10) Patent No.: US 8,277,763 B2
(45) Date of Patent: Oct. 2, 2012

(54) INCUBATOR APPARATUS AND METHOD

(75) Inventors: Philipp Steinmann, Glasgow (GB); Gabriela Juárez Martinez, Glasgow (GB)

(73) Assignee: Centeo Biosciences Limited, Glasgow (GB)

( * ) Notice: Subject to any disclaimer, the term of this patent is extended or adjusted under 35 U.S.C. 154(b) by 217 days.

(21) Appl. No.: 12/224,259

(22) PCT Filed: Feb. 28, 2007

(86) PCT No.: PCT/GB2007/000695

§ 371 (c)(1),
(2), (4) Date: Aug. 22, 2008

(87) PCT Pub. No.: WO2007/099311

PCT Pub. Date: Sep. 7, 2007

(65) Prior Publication Data

US 2009/0011495 A1 Jan. 8, 2009

(30) Foreign Application Priority Data

Feb. 28, 2006 (GB) ..... 0603965.5

(51) Int. Cl.
*B01L 3/00* (2006.01)

(52) U.S. Cl. ..... 422/553; 422/400; 422/401; 422/407; 422/500; 422/560; 422/561; 435/3; 435/285.1; 435/286.1; 435/286.2; 435/287.2; 435/288.4; 435/288.7; 435/303.1; 435/34; 435/374; 435/809; 435/6.14; 435/7.1; 435/91.2; 436/157; 136/242; 159/6.1; 165/185; 204/403.01; 219/428; 219/476; 219/628; 219/752; 356/243.1; 356/246; 361/679.46; 361/704; 73/64.56; 237/3; 237/4; 237/14; 236/2; 236/3; 236/4; 236/5; 236/91 A

(58) Field of Classification Search ..... 422/99, 422/138, 146, 198, 202, 235, 307, 400, 401, 422/407, 500, 551, 553, 560, 561; 436/157; 237/3, 4, 14; 236/2, 3, 4, 5, 91 A; 435/3, 285.1, 286.1, 286.2, 287.2, 288.1, 288.4, 288.7, 303.1, 34, 374, 6, 6.14, 7.1, 91.2, 809; 136/242; 159/6.1; 165/185; 204/403.01; 219/428, 476, 628, 752; 356/243.1, 246; 361/679.46, 704; 73/64.56
See application file for complete search history.

(56) References Cited

U.S. PATENT DOCUMENTS 6,032,474 A 3/2000 Dale et al.

(Continued)

FOREIGN PATENT DOCUMENTS

EP 1 681 547 7/2006

(Continued)

OTHER PUBLICATIONS

Belgrader et al, "A Battery-Powered Notebook Thermal Cycler for Rapid Multiplex Real-Time PCR Analysis", 2002, Anal. Chem., 73, 286-289.*

(Continued)

*Primary Examiner* — Dennis M White
(74) *Attorney, Agent, or Firm* — Defillo & Associates, Inc.; Evelyn A. Defilló

(57) ABSTRACT

The present invention relates to a method of processing analyte using a portable incubator apparatus. The incubator apparatus 10 has a plurality of cavities 20 each configured to receive analyte to be incubated. The method comprises: receiving analyte in each of the plurality of cavities; incubating the analyte in the plurality of cavities, the incubator apparatus being operable to control temperatures of analyte contained in the plurality of cavities independently of each other; and moving the incubator apparatus from a first location to a second location while the analyte is being incubated, the incubator apparatus being configured to maintain desired incubation conditions independently of a supply of electrical power and apparatus external to the incubator apparatus as the incubator apparatus is being moved.

19 Claims, 5 Drawing Sheets

U.S. PATENT DOCUMENTS

| | | | | |
|---|---|---|---|---|
| 6,558,947 | B1 * | 5/2003 | Lund et al. | 435/303.1 |
| 6,699,713 | B2 * | 3/2004 | Benett et al. | 435/287.2 |
| 2002/0182631 | A1 | 12/2002 | Schurmann-Mader et al. | |
| 2005/0029246 | A1 | 2/2005 | Gunter | |
| 2005/0184042 | A1 * | 8/2005 | Brown et al. | 219/428 |

FOREIGN PATENT DOCUMENTS

| | | |
|---|---|---|
| WO | WO 96/39482 | 12/1996 |
| WO | WO 96/40858 | 12/1996 |
| WO | WO 00/32312 | 6/2000 |
| WO | WO 01/43875 | 6/2001 |
| WO | WO 03/022439 | 3/2003 |
| WO | WO 2005/045399 | 5/2005 |
| WO | WO 2005/097325 | 10/2005 |

OTHER PUBLICATIONS

Yang et al, "High Sensitivity PCR assay in plastic micro reactors", 2002, Lab on a Chip, 2, 179-197.*

SBS for Microplates—Footprint Dimensions, ANSI American National Standards Institute, ANSI/SBS 1-2004, dated Jan. 25, 2006, pp. 1-8.

Japanese Office Action dated Nov. 22, 2011, 4 pgs. (English translation).

* cited by examiner

INCUBATOR APPARATUS AND METHOD

FIELD OF THE INVENTION

The present invention relates to a method of processing analyte using a portable incubator apparatus and such a portable incubator apparatus.

BACKGROUND TO THE INVENTION

In biological and chemical assays, such as protein crystallisation, variables such as buffer composition, concentration, pH and the nature of chemical additives, often need to be screened and controlled. In recent years assays have been performed in a parallel manner. For example, an assay is automated and performed on a two-dimensional array of analyte samples such that data is acquired at the same time from the analyte samples in the array. This reduces the time and costs involved in such assays.

In protein crystallisation, crystallisation conditions for a given protein can be optimised by investigating the parameter space defined by temperature, pH, ionic strength and additional agents. Normally investigations involve dispensing a crystallisation solution into a container, sealing the container and incubating the contained solution for a period of, typically, one week to three months. During this period the contained solution is inspected, e.g. under the microscope, for formation of crystals. Clearly such investigations can be exhaustive and thus make the process repetitive and time-consuming. Thus, performing the investigations in a parallel manner can reduce the time and cost involved.

A number of incubators with a temperature control facility have been reported. Such incubators can be used for protein crystallisation investigations. In one example, the incubator has an aluminium plate, such as a microtiter plate, which defines an array of wells that are configured to receive protein in solution. In use, hot and/or cold water is circulated around the plate to control the temperature of protein solution held in the plate.

WO 03/080900 describes a system for growing crystals, such as protein crystals. The system has an array of wells or channels defined in a substrate which are configured to receive a crystallisation solution. Associated with the array of wells or channels is a temperature controller for creating a temperature differential across the array.

It has been appreciated that proper temperature management during protein crystallisation assays can prevent the breakdown of valuable analyte material, can increase the reproducibility of experimental results and can aid in the discovery of fresh parameters that hitherto could not be investigated. However, proper temperature management of assays performed in a parallel manner has hitherto proved difficult.

It is an object of the invention to provide a method of and apparatus for incubating analyte, e.g. for the purpose of protein crystallisation.

STATEMENT OF INVENTION

The present inventors have appreciated known methods and apparatus to have shortcomings. The present invention has been devised in the light of this appreciation. Thus, from a first aspect there is provided a method of processing analyte using a portable incubator apparatus, the incubator apparatus having a plurality of cavities each configured to receive analyte to be incubated, the method comprising: receiving analyte in each of the plurality of cavities; incubating the analyte in the plurality of cavities, the incubator apparatus being operable to control temperatures of analyte contained in the plurality of cavities independently of each other; and moving the incubator apparatus from a first location to a second location whilst the analyte is being incubated, the incubator apparatus being configured to maintain desired incubation conditions independently of a supply of electrical power and apparatus external to the incubator apparatus as the incubator apparatus is being moved.

During the incubation period, the incubation apparatus can be moved from the first location to a second station whilst the analyte is being incubated by virtue of the capability of the incubator apparatus to maintain desired incubation conditions independently of a supply of electrical power and apparatus external to the incubator apparatus. Thus, for example, the analyte may be dispensed into the plurality of cavities at an automated dispensing station (i.e. at the first location) and then moved, while incubation is on-going, to a storage location (i.e. at the second location) where the incubation process is completed over time.

The present invention is based on the appreciation that movement of incubation apparatus from location to location in circumstances in which the ambient temperature is liable to change can jeopardise the stability of the analyte being incubated. For example, an analyte may be subject to a temperature fluctuation during movement that causes an irreversible change to the analyte that prevents proper analysis. According to the present invention, this problem is addressed by the incubation apparatus maintaining the desired incubation conditions during movement.

Furthermore, the incubation apparatus is operative during the incubation period to control the temperature of the analyte contained in the plurality of cavities independently of each other. For example, analyte in a first cavity may be maintained at a first temperature, such as 4° C., and analyte in a second cavity may be maintained at a second temperature, such as 35° C. This provides for two investigations at different temperatures to be performed at the same time thereby reducing the length of time that investigations are carried out on the analyte in question.

More specifically, the incubator apparatus may be configured to maintain a desired analyte temperature despite a change in ambient temperature as the incubator apparatus is being moved.

Alternatively or in addition, the analyte received in the plurality of cavities may comprise at least one of a biological and a non-biological compound.

Alternatively or in addition, the analyte received in the plurality of cavities may comprise at least one of: a protein, DNA, RNA, and stem cells.

Alternatively or in addition, the analyte may be liable to undergo an irreversible change, which is prejudicial to subsequent analysis of the analyte, when the analyte is subject to adverse incubation conditions.

Alternatively or in addition, the analyte may comprise a compound that is liable to crystalise when subject to an adverse incubation temperature. Thus, the method may form part of at, least one of: biological crystallisation; non-biological crystallisation; an enzyme kinetics process; a fermentation process; a polymer science process; stem cell storage; polymerase chain reaction (PCR); a polymer science process; and similar such DNA related processes.

Alternatively or in addition, the incubator apparatus may be configured to selectively: heat analyte received in the plurality of cavities; and cool analyte received in the plurality of cavities.

Alternatively or in addition, the incubator apparatus may be configured to at least one of: heat analyte contained in the plurality of cavities independently of each other; and cool analyte contained in the pluralities independently of each other.

Alternatively or in addition, the incubator apparatus may be configured to selectively: transfer heat from analyte received in at least one cavity; and transfer heat to analyte received in at least one cavity.

Alternatively or in addition, the incubator apparatus may comprise a temperature controller operable to control the temperatures of analyte contained in the plurality of cavities.

It is to be understood that the scope of the invention is not limited to the independent control of temperatures of analyte in only two cavities. Indeed, the temperatures of analyte in more than two cavities or groups of cavities may be independently controlled. Thus, where there are, for example, five cavities or groups of cavities five investigations can be performed at the same time with a corresponding saving in investigation time and in user efforts.

Alternatively or in addition, the incubator apparatus may be configured to create at least one temperature differential across a plurality of cavities.

Alternatively or in addition, the incubator apparatus may be is configured to control temperatures of analyte contained in at least two groups of cavities independently of each other. More specifically, the incubator apparatus may be configured to maintain a first group of cavities at a first temperature and to maintain a second group of cavities at a second temperature, the first and second temperatures being different to each other.

Alternatively or in addition, the temperature controller may be operable to create at least one temperature gradient across a plurality of cavities.

Alternatively or in addition, the incubator apparatus may be configured such that the temperature controller is operable to create at least two temperature gradients across the plurality of cavities, the first temperature gradient being across a first group of cavities and the second temperature gradient being across a second group of cavities, and the first and second temperature gradients being independently controlled.

Alternatively or in addition, the temperature controller may be operable to vary the temperatures of analyte contained in the plurality of cavities in relation to an ambient temperature. Thus, the temperatures of analyte may be greater or less than ambient temperature. More specifically, the temperatures of analyte may be between about 4° C. and about 35° C. Thus the term incubator as used herein is intended to cover apparatus that cools analyte as well as apparatus that heats analyte.

Alternatively or in addition, the plurality of cavities may comprise at least one of a well and a channel. The cavities (i.e. well or channel) may be of substantially the same form, e.g. shape and/or size. Alternatively, the cavities may be of substantially different form. The cavities may be of known or standard forms.

Alternatively or in addition, the plurality of cavities may be disposed in the incubator apparatus in a two-dimensional array, e.g. a five by six array of wells.

Alternatively or in addition, the plurality of cavities may be disposed in the incubator apparatus as an array, e.g. an array of channels.

Alternatively or in addition, the incubator apparatus may comprise solid-state heating/cooling apparatus.

Alternatively or in addition, the temperature controller may comprise at least one Peltier heat pump. The Peltier heat pump may be configured and operable to control the temperature of analyte contained in one of the at least two cavities.

Alternatively or in addition, the temperature controller may comprise at least two Peltier heat pumps. Each Peltier heat pump may be configured and operable to control the temperature of analyte contained in one of the at least two cavities. More specifically, each Peltier heat pump may be configured and operable to control the temperature of analyte contained in one of the plurality of cavities.

Alternatively or in addition, the incubator apparatus may comprise a plurality of temperature sensors each operable to sense a respective temperature of analyte contained in the plurality of cavities. More specifically, at least one of the plurality of temperature sensors may be a thermistor, such as an R-T matched thermistor.

Alternatively or in addition, a temperature controller of the incubator apparatus may operate in dependence upon the temperatures sensed by the plurality of temperature sensors.

Alternatively or in addition, the temperature controller may be operable to regulate the temperatures of analyte contained in the plurality of cavities in relation to a respective predetermined temperature.

Alternatively or in addition, the incubator apparatus may further comprise a Proportional, Integral and Derivative (PID) module operable to control temperatures of analyte contained in the plurality of cavities.

Alternatively or in addition, the incubator apparatus may comprise a power supply operable to provide electrical power for independent operation of the incubator apparatus. More specifically, the power supply may comprise a battery.

Alternatively or in addition, the incubator apparatus may comprise cooling apparatus configured to transfer heat away from the plurality of cavities. More specifically, the cooling apparatus may comprise at least one heat sink thermally coupled to at least one of the plurality of cavities. More specifically, the heat sink may be thermally coupled to a plurality of cavities. More specifically, the heat sink may be thermally coupled to a plurality of linearly disposed cavities.

Alternatively or in addition, the at least one heat sink may be proximate at least one of the plurality of cavities.

Alternatively or in addition, the at least one heat sink may be disposed laterally of the cavity in relation to an opening to the cavity through which the analyte is received in the cavity.

Alternatively or in addition, the at least one heat sink may be disposed on a side of the cavity opposite an opening to the cavity through which the analyte is received in the cavity. This configuration has the advantage of providing space laterally of the cavities. Such space may, for example, be used for further cavities.

Alternatively or in addition, the at least one heat sink may be comprised in at least part of a casing of the incubator apparatus. Thus, for example, the cooling apparatus may comprise a heat sink proximate the cavities, the heat sink being thermally coupled to the casing, which in turn acts as a heat sink.

Alternatively or in addition, the cooling apparatus may be thermally coupled to heating/cooling apparatus of the incubator apparatus.

Alternatively or in addition, the incubator apparatus may further comprise an interface configured to provide for communication between the incubator apparatus and a computer, such as a Personal Computer (PC). More specifically, the incubator apparatus may be configured to be programmed by the computer via the interface by the computer.

Alternatively or in addition, the incubator apparatus may further comprise at least one sealing element for sealing analyte received in at least one cavity.

Alternatively or in addition, the incubator apparatus may further comprise at least one light source configured to illuminate analyte contained in the plurality of cavities. More specifically, the incubator apparatus may comprise a plurality of light sources, each configured to illuminate a respective one of the plurality of cavities.

Alternatively or in addition, the at least one light source may be configured to illuminate analyte contained in the plurality of cavities from a side of the cavities opposed to openings of the cavities through which the analyte is received. Thus, where the cavity openings face upwards the at least one light source can provide back-lighting for the cavities. Back-lighting can provide for optical inspection of the analyte contained in the incubator apparatus, e.g. by means of a microscope.

Alternatively or in addition, the at least one light source may comprise a Light Emitting Diode (LED).

Alternatively or in addition, the incubator apparatus may be configured to change a brightness of the at least one light source.

Alternatively or in addition, the plurality of cavities may be defined by a receptacle comprised at least in part of material that allows for the passage of light.

Alternatively or in addition, the incubator apparatus may define a substantially rectangular footprint over the ground when in use.

Alternatively or in addition, the incubator apparatus may be of a robot handler compatible form. For example, the incubator apparatus may be of an SBS format having a footprint of 85.48 mm±0.25 mm by 127.76 mm±0.25 mm or of a Linbro plate format having a footprint of 150 mm by 108 mm by 22 mm.

The incubator apparatus may be laboratory apparatus. More specifically, the laboratory apparatus may be configured for at least one of chemical and biological applications. Such applications may be of the nature of laboratory type procedures. For example, the incubator apparatus may be configured for at least one of biological crystallisation, an enzyme kinetics process, a fermentation process, a polymer science process, stem cell storage, polymerase chain reaction (PCR) and similar such DNA related processes.

Alternatively or in addition, the plurality of cavities may be formed in an analyte containing member. More specifically, the analyte containing member may be removable from the incubator apparatus.

Alternatively or in addition, the analyte containing member may comprise a plurality of cavities, with each cavity containing a plurality of wells.

Alternatively or in addition, the analyte containing the member may be of a recognised form. For example, the analyte containing member may be a microtiter plate.

Alternatively or in addition, the analyte containing member may be formed of a plastics material. Alternatively or in addition, the analyte containing member may comprise thermal insulation between the plurality of cavities.

Alternatively or in addition, the analyte containing member may be a unitary member.

Alternatively or in addition, the analyte containing member may comprise at least two container members, each container member comprising a respective one of the at least two cavities. More specifically, the incubator apparatus may be configured such that the at least two container members are spaced apart from each other when in use in the incubator apparatus. Thus, the cavities in the container members may be thermally insulated from each other.

Alternatively or in addition, the incubator apparatus may be configured to be hand-held.

Alternatively or in addition, a temperature in at least one of the plurality of cavities may be recorded. More specifically, the temperature may be recorded when the incubator apparatus is being moved from the first location to the second location.

Alternatively or in addition, a recorded temperature may be at least one of: displayed to a user of the incubator apparatus; communicated to apparatus at the second location.

Alternatively or in addition, the incubator apparatus may be stored in a storage unit at at least one of the first and second locations, the storage unit being configured to support a plurality of incubator apparatus. More specifically, the storage unit may be configured to support the plurality of incubator apparatus such that they share substantially the same footprint over the ground when in use.

According to a second aspect of the present invention, there is provided portable incubator apparatus comprising a plurality of cavities, each configured to receive analyte to be incubated, the incubator apparatus being configured: to control temperatures of analyte contained in the plurality of cavities independently of each other; and to be moved from a first location to a second location whilst the analyte is being incubated, the incubator apparatus being configured to maintain desired incubation conditions independently of a supply of electrical power and apparatus external to the incubator apparatus as the incubator apparatus is being moved.

Embodiments of the second aspect of the present invention may comprise one or more features of the first aspect of the present invention.

According to a third aspect of the present invention there is provided an incubator storage apparatus comprising a storage unit and a plurality of portable incubator apparatus according to the second aspect of the invention, the storage unit being configured to support each of the plurality of incubator apparatus when in use.

More specifically, the storage unit may be configured to support the plurality of incubator apparatus such that they share substantially the same footprint over the ground when the incubator storage apparatus is in use.

Further embodiments of the third aspect of the present invention may comprise one or more features of the first or second aspects of the present invention.

According to a fourth aspect of the present invention, there is provided portable incubator apparatus comprising a plurality of cavities, each configured to receive analyte to be incubated, the incubator apparatus being configured: to control temperatures of analyte contained in the plurality of cavities independently of each other; and to be moved from a first location to a second location whilst the analyte is being incubated, the incubator apparatus further comprising at least one heat sink disposed on a side of at least one of the cavities opposite an opening to the cavity through which the analyte is to be received.

Embodiments of the fourth aspect of the present invention may comprise one or more features of the first to third aspects of the present invention.

According to a fifth aspect of the present invention there is provided an incubator storage apparatus comprising a storage unit and a plurality of portable incubator apparatus, the storage unit being configured to support each of the plurality of incubator apparatus when in use, the portable incubator apparatus comprising a plurality of cavities, each configured to receive analyte to be incubated, the incubator apparatus being configured: to control temperatures of analyte contained in the plurality of cavities independently of each other; and to be moved from a first location to a second location whilst the analyte is being incubated.

Embodiments of the fifth aspect of the present invention may comprise one or more features of the first to fourth aspects of the present invention.

According to a further aspect of the present invention, there is provided incubator apparatus comprising a plurality of cavities, each configured to receive analyte to be incubated, the incubator apparatus being configured to control temperatures of analyte contained in the plurality of cavities independently of each other.

Embodiments of the further aspect of the present invention may comprise one or more features of the first to fifth aspects of the present invention.

BRIEF DESCRIPTION OF DRAWINGS

Further features and advantages of the present invention will become apparent from the following specific description, which is given by way of example only and with reference to the accompanying drawings, in which.

SPECIFIC DESCRIPTION

Figure 1:
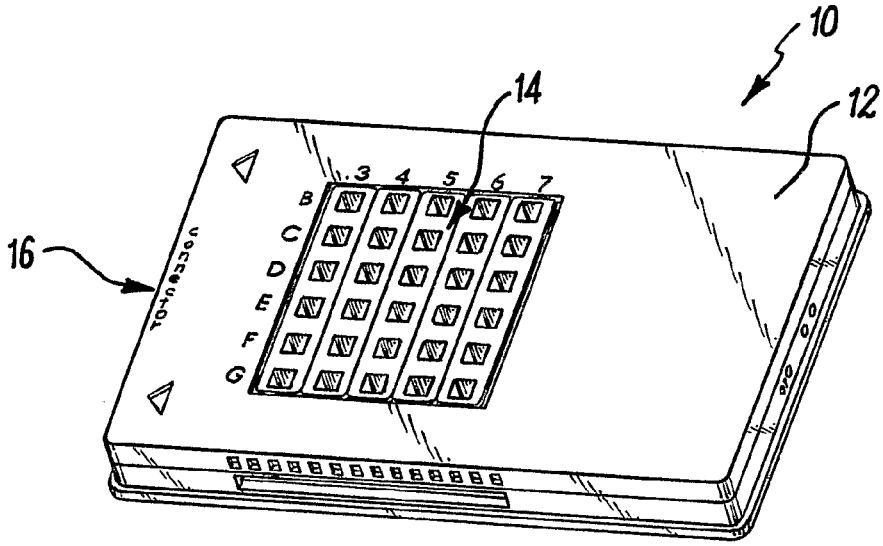
FIG. 1 is a perspective view of an incubator apparatus according to the present invention.

An incubator apparatus 10 according to the invention is shown in FIG. 1. The incubator apparatus comprises a main body 12 that holds an inlay 14 (which constitutes an analyte containing member), which is removable from the main body 12. The incubator apparatus is of an SBS format having a footprint of 85.48 mm±0.25 mm by 127.76 mm±0.25 mm thus making it suitable for handling by robotic high-throughput systems. Thus, the footprint is in accordance with American National Standards Institute (ANSI) standard ANSI/SBS 1-2004. The incubator apparatus 12 is provided with electrical connector 16.

The component parts of the incubator apparatus 10 will now be described in more detail with reference to the exploded view shown in FIG. 2.

The inlay 14 defines a five by six two-dimensional array of wells 20 (which constitute a plurality of cavities). The position of the wells is in accordance with the ANSI/SBS 4-2004 standard for well positions for microplates. The inlay 14 is formed of a plastics material such as polycarbonate. Thus, by virtue of the plastics material there is thermal insulation between the rows of the inlay. The inlay 14 is received in the incubator apparatus 10 through an aperture formed in an upper part 22 of the same apparatus casing. The incubator apparatus 10 also comprises a lower part 24 of the apparatus casing. The upper and lower parts 22, 24 together provide an enclosure for the incubator apparatus 10. The upper and lower parts 22, 24 of the apparatus casing are formed of a chemically robust material, such as Nylon. Alternatively, the upper and lower parts 22, 24 may function as heat sinks. In such a form, the upper and lower parts may be formed at least in part of one or more materials that are commonly used to form heat sinks.

In an un-illustrated form of the inlay, the inlay comprises five separate inlay members with each inlay member for one row of the array of wells 20.

Components internal to the incubator apparatus 10 will now be described. A printed circuit board 30 comprises the control electronics, which will be described below. The printed circuit board 30 is a conventional four-layer board of a thickness of 1 mm. A heatsink 32 formed of copper or aluminium is physically attached by conventional means to the printed circuit board such that they make good thermal and electrical contact. The purpose of the heatsink 32 is dissipation of heat generated by the heat pumps (described below) and by electronic components. A further optional heat management measure is the inclusion of forced cooling by means of an electric fan (not shown) in accordance with conventional practice. A thermal insulator 34 is mounted on the printed circuit board 30. The thermal insulator is shaped to insulate rows of wells 20 in the inlay 14 from each other and from the printed circuit board 30. The thermal insulator 34 is formed of polyurethane with 60% glass fibre to the UL94-V0 rating. Light emitting diodes (LEDs) 36 are mounted on the printed circuit board 30 at locations corresponding to wells 20 in the inlay 14. The LEDs 34 are driven by means of electronic circuitry provided on the printed circuit board 30 designed in accordance with well established design practice. The brightness and spectral composition of the LEDs 36 can be matched to requirements of conventional automated Charge-Coupled Device (CCD) inspection tools. Mounted on the thermal insulator 34 is a tray 38 that defines a five by six two-dimensional array of wells each of which is configured to receive a well 20 of the inlay. The five by six two-dimensional array of wells of the tray 38 is formed by five blocks, with each block constituting a row of the array and having six wells. The tray 38 is formed of a metal having good thermal conductivity, such as aluminium or copper. Each well in the tray 38 is configured to allow light emitted by its respective LED 36 to illuminate analyte contained within wells 20 of the inlay 14, e.g. by means of an aperture in the wall of each well in the tray, which allows for the passage of LED light. Each block of the tray 38 is associated with two Peltier heat pumps 40 mounted in the printed circuit board 30. The Peltier heat pumps 40 will be described below with reference to FIG. 3. A battery 42 is provided to provide for portable operation. The nominal voltage is 3.7 V and the capacity is 1000 mAh. A rechargeable battery such as a Varta Easypack 1000 is used. Power for the incubator apparatus 10 may also be provided from an external source (not shown) in accordance with conventional practice. Status LEDs 44 operate to provide an indication of status of the incubator apparatus 10 during use. Connectors 46 provide for serial communications (e.g. RS485 or RS232) and parallel communications. Serial communication is used for programming the temperature in each well 20 of the inlay 14 and for output of recorded temperature data. Parallel communications to JTAG standard is used for programming a microcontroller (not shown) on the printed circuit board 30 and for testing of incubator apparatus firmware.

Figure 2:
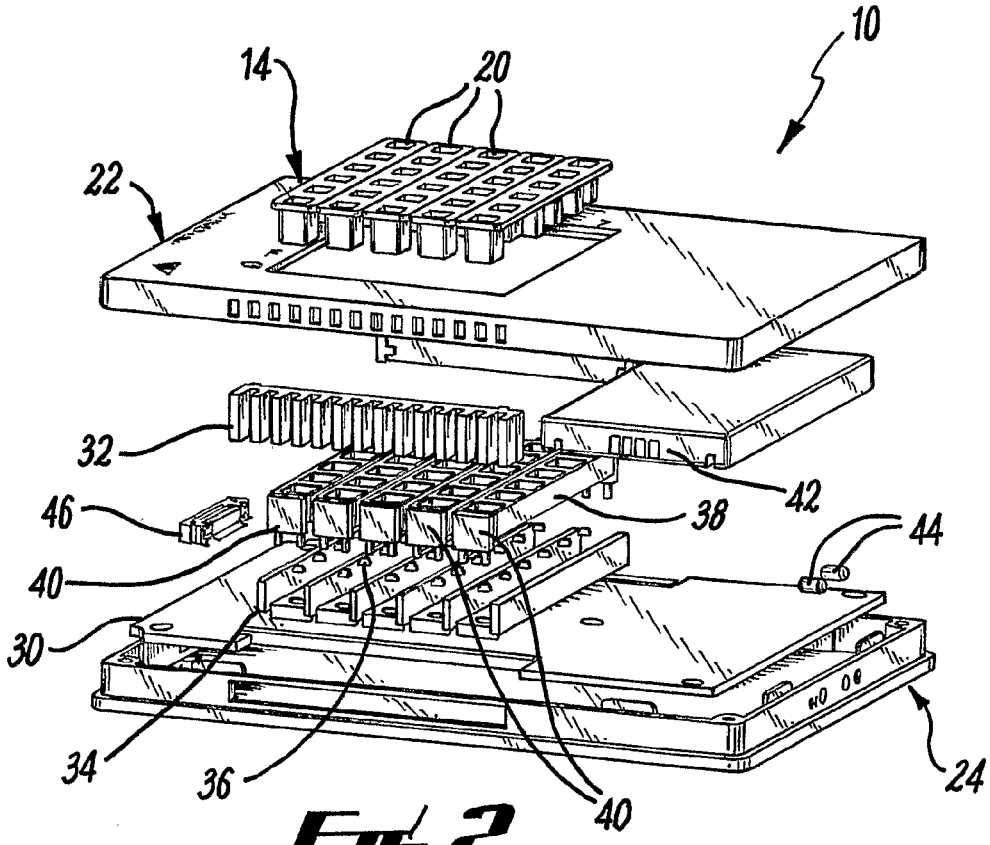
FIG. 2 is an exploded view of the incubator apparatus of FIG. 1.
Figure 3A:
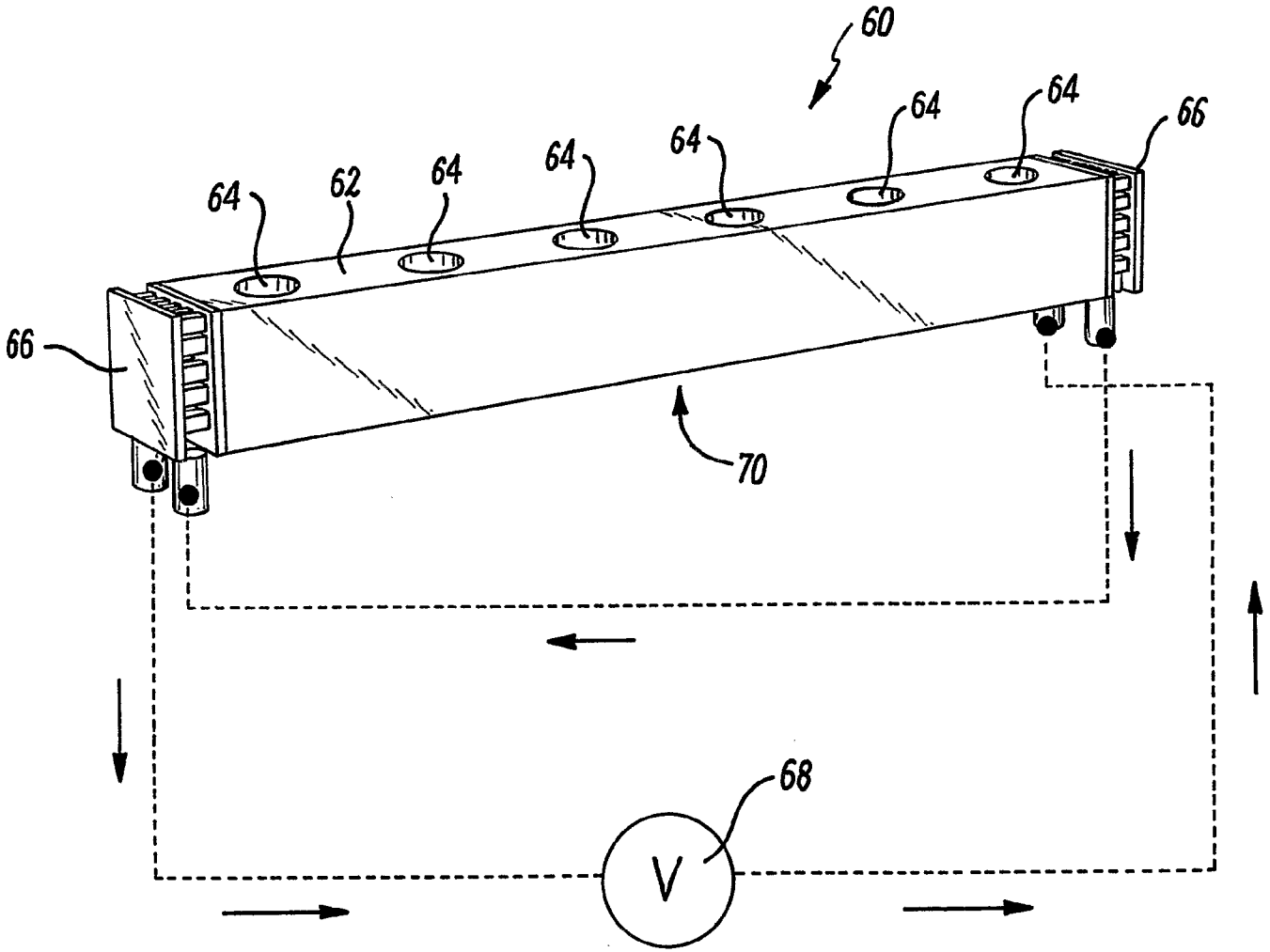
FIG. 3*a* is a view of two Peltier heat pumps used in the incubator apparatus of FIGS. 1 and 2 according to a first embodiment.

FIG. 3*a* shows a block of 60 of the tray 38 of FIG. 2 in more detail and according to a first embodiment. The block 60 comprises a metal member 62, which defines six spaced apart wells 64 each of which receives, in use, a well 20 of the inlay 14. Two Peltier heat pumps 66 are disposed around the ends of the metal member 62. An appropriate Peltier heat pump is Marlow Industries MI1011T, having a body size of 6.6 mm by 6.6 mm, a maximum current of 1 A and a maximum voltage of 2V. The Peltier heat pumps 66 are connected in series and powered by a voltage source 68. The disposition of the Peltier heat pumps 66 at each end of the inlay provides for a uniform temperature across the inlay. The arrows shown in FIG. 3 beside the dotted lines indicate the direction of current flow. More specifically, the Peltier heat pumps are driven by a Texas Instruments MOSFET H-bridge using a Texas Instruments DRV591. The output voltage level of the Texas Instruments DRV591 is controlled by a Texas Instruments DAC7558 digital-to-analogue converter, which is in turn controlled, by the apparatus microcontroller. Each output from the Peltier heat pump driver is filtered by means of a passive LC filter to provide a DC driving voltage with less than 10% ripple. The design of driver circuits for the Peltier heat pump is a straightforward matter for the notional skilled person involving reference to standard texts, e.g. such as is provided in data sheets for the main components, namely the Peltier heat pump itself, the Texas Instruments DRV591 and the Texas Instruments DAC7558 digital-to-analogue converter. An R-T matched thermistor 70 is mounted on the underside of the metal member 62 to provide an electrical resistance that is measured by the apparatus microcontroller to determine the temperature by means of a look-up table in accordance with well-established practice. Accuracy of temperature measurements is better than 0.5° C. without calibration of circuitry associated with each thermistor 70.

Figure 3B:
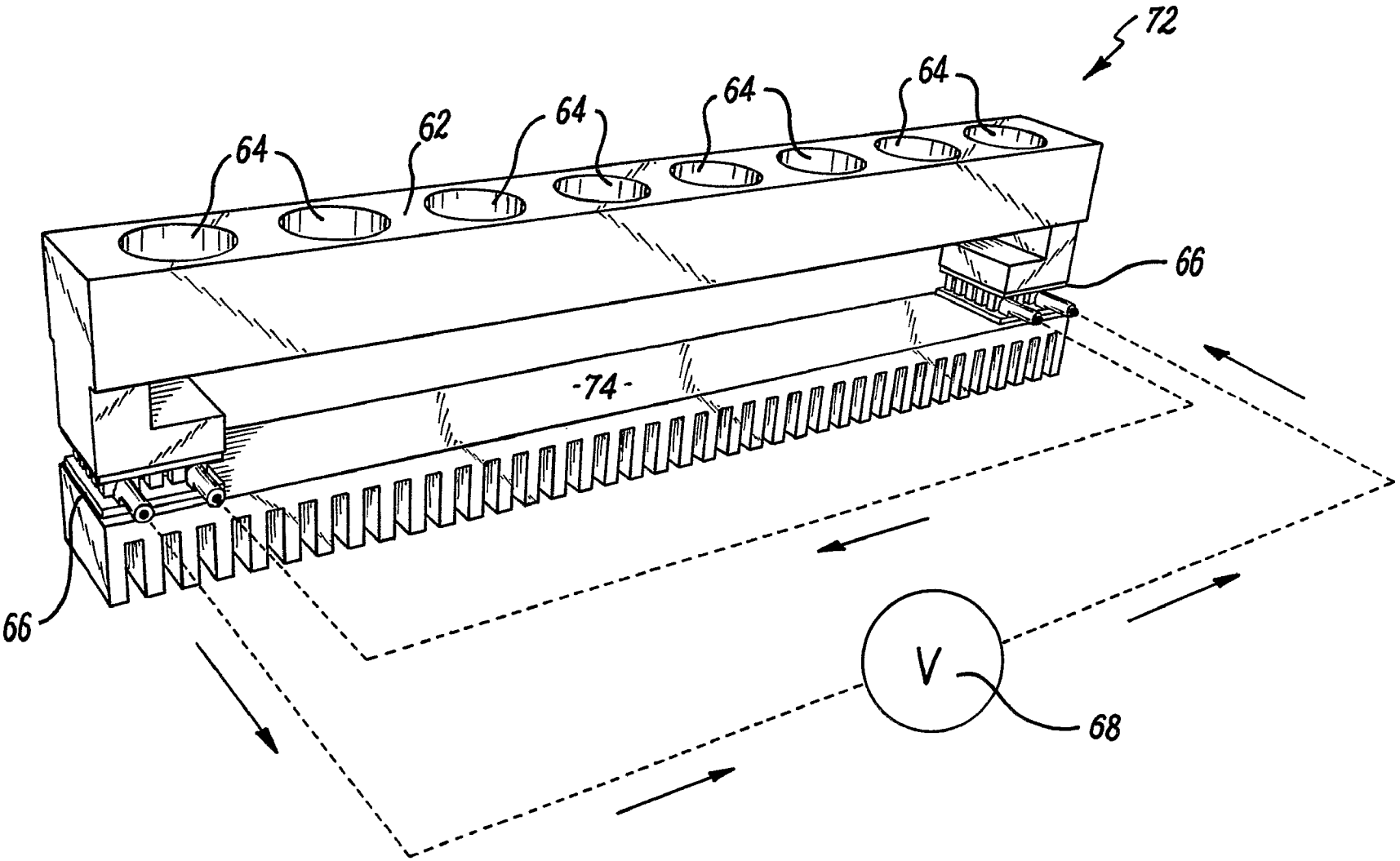
FIG. 3*b* is a view of two Peltier heat pumps used in the incubator apparatus of FIGS. 1 and 2 according to a second embodiment.

FIG. 3*b* shows a block of 72 of the tray 38 of FIG. 2 according to a second embodiment. The components and function of the embodiment shown in FIG. 3*b* is the same as for the first embodiment described above with reference to FIG. 3*a*, except as described as follows. The Peltier heat pumps 66 are located underneath the metal member 62 (i.e. on the side of the metal member 62 opposing the apertures of the wells 64) instead of being located at opposing lateral sides of the metal member 62. A heat sink 74 is located underneath and in contact with the Peltier heat pumps 66. As can be seen from FIG. 2, the heat sinks 32 of the first embodiment are located at the lateral sides of the wells 20. Thus, the configuration of the second embodiment provides space around the wells, which may, for example, be used to provide further wells.

The provision of digital control of the Peltier heat pump 40, 66 and a digital representation of measured temperature in wells 20 of the inlay 14 provide for closed loop digital control by means of the apparatus microcontroller. To this end, a Proportional, Integral and Derivative control program is provided in the microcontroller. The Proportional, Integral and Derivative control program is designed and functions in accordance with conventional practice. The microcontroller, which is not shown in the drawings but which is mounted on the printed circuit board 30, is a Freescale 56F8123 hybrid Digital Signal Processor (DSP)/microcontroller. Support circuitry for the microprocessor is designed in accordance with standard design practice, e.g. as based on datasheets provided by the microprocessor manufacturer.

Figure 4:
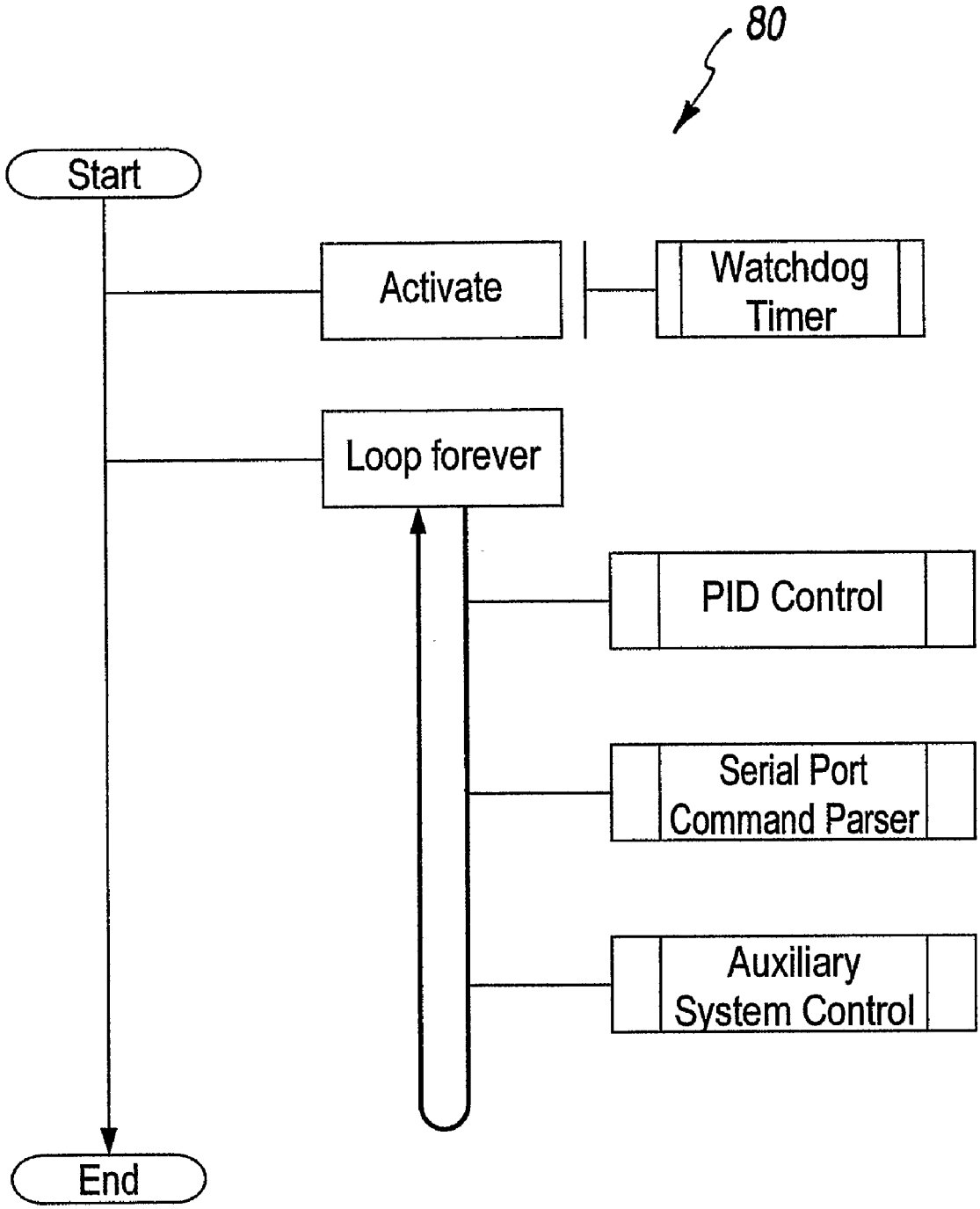
FIG. 4 is a flow chart showing firmware operations during use of the incubator apparatus.

Firmware executed by the microprocessor is represented in FIG. 4 in flow chart form 80. Firmware design is in accordance with conventional, well-established practice. Firmware functions represented in FIG. 4 will be self-evident to the notionally skilled reader in the light of the description above. In summary, the microprocessor firmware provides the following functions:

Incubator apparatus set-up, control and diagnostics.

Communications via the connector 16 with a Personal Computer (PC) (not shown).

Remote control by a PC.

PID control.

Under firmware control the temperatures measured by the thermistors 70 is recorded, e.g. in solid-state memory. Temperature recordal continues when the apparatus is being moved from one location to another. Although, not shown in the Figures the temperature may be displayed on an LED or LCD display in accordance with well known design practice. Such a display is for the benefit of a user who may be carrying the apparatus from one location to another. Thus, the user can monitor the analyte temperature vis-à-vis any critical temperature changes or levels that may affect the stability of the analyte. Alternatively or in addition, the recorded temperatures may be communicated via the connector 16 for use elsewhere, e.g. at a location to which the apparatus has been moved, for monitoring purposes.

Use of the incubator apparatus for protein crystallisation will now be described with reference to FIGS. 1 to 3. A fresh inlay 14 is inserted into the incubator apparatus 10 through the aperture provided in the upper part of 22 of the apparatus casing such that the wells 20 of the inlay are received in the wells of the tray 38. An analyte containing protein, salts, detergents and other stabilising chemicals is dispensed into the wells of 20 of inlay 14. The wells 20 are then sealed, e.g. with tape or oil, before operation of the incubator is started in accordance with a firmware program resident in the microprocessor to begin an incubation period, e.g. of one week to three months. The incubator may be started before analyte is put into the wells 20. The provision of Peltier heat pumps with each of the five blocks of the tray 38 provides for independent control of temperatures of analyte contained in wells 20 received within the blocks. This means that the incubator apparatus 10 can subject analyte contained in the apparatus to up to five different temperature regimes within the incubation period. In an un-illustrated form, the two Peltier heat pumps 66 are driven independently of each other so that they operate at a different temperature to each other within a range between about 4° C. and about 35° C. Thus, a thermal gradient can be established along the block between the two Peltier heat pumps 66. Closed loop control by means of the thermistor 70 associated with each block of the tray 38 in the series connected and independently controlled Peltier heat pump embodiments provides for an absolute accuracy better than 0.5° C. Temperature control during the incubation period is by means of the PID control functions executed by the microprocessor. For example, a temperature within a particular block of the tray 38 can be maintained during the incubation period or a change of temperature can be effected during the incubation period. During the incubation period a user, such as a research scientist, can periodically inspect the analyte contained in each well 20 under the microscope making use of back-lighting provided by the LEDs 36.

It is to be noted that the provision of the incubator apparatus in an SBS format means that robotic handling apparatus can be used for moving, filling, sealing and optical inspection of the apparatus 10.

Figure 5:
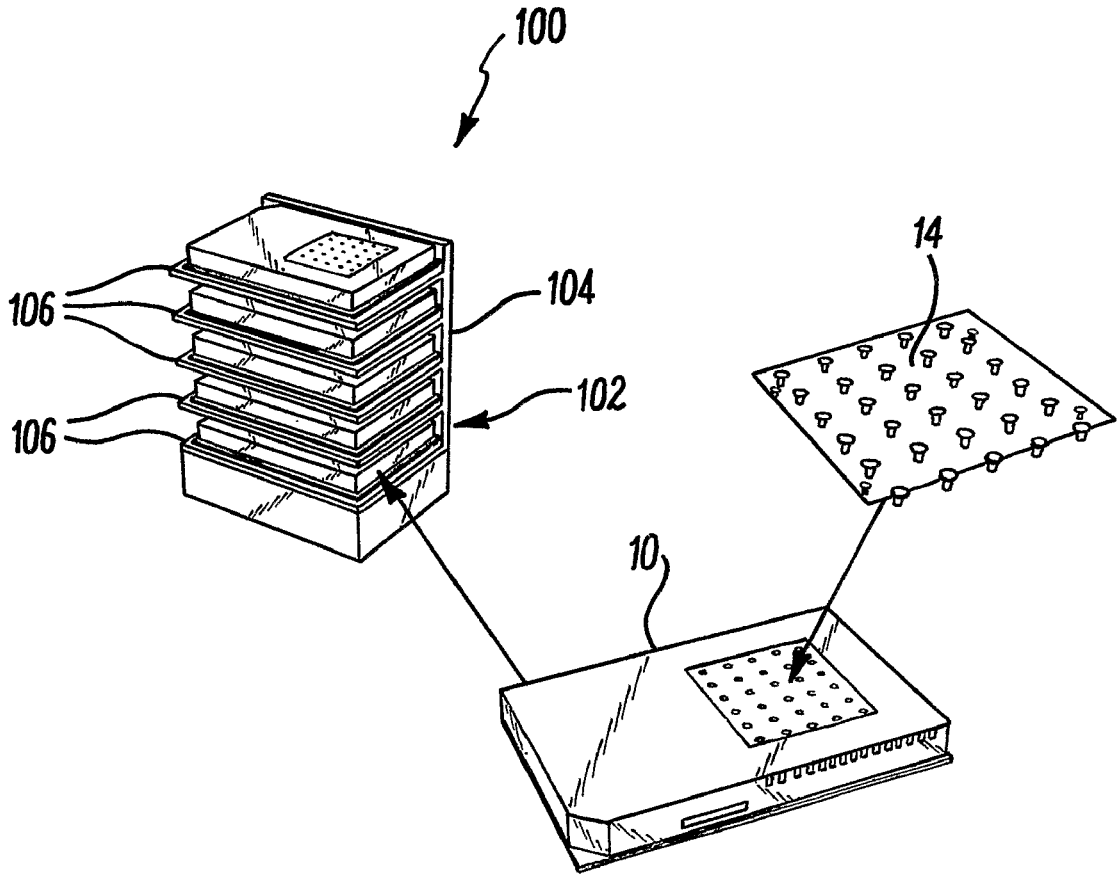
FIG. 5 is a perspective view of incubator storage apparatus according to the invention.

FIG. 5 shows an incubator storage apparatus 100. The incubator storage apparatus 100 comprises a storage unit 102 that is configured to support five incubator apparatus 10. The storage unit 102 comprises a backplane 104 that extends vertically when the incubator storage apparatus 100 is in use. Shelves 106 extend horizontally from the backplane 104. An incubator apparatus 10 can be supported on each shelf 106. The incubator storage apparatus 100 provides for space efficient storage of incubator apparatus 10.

The invention claimed is:

1. An SBS footprint portable incubator apparatus comprising: a plurality of cavities, each configured to receive an analyte to be incubated;

wherein the portable incubator apparatus has an SBS format footprint in accordance with ANSI/SBS 1-2004 and is configured to control temperatures of analyte contained in the plurality of cavities independently of each other; and the portable incubator apparatus is further configured to maintain desired incubation conditions, independently of a supply of electrical power and external apparatus, while the portable incubator apparatus is moved from a first location to a second location, the portable incubator apparatus comprising at least one heat sink thermally coupled to at least one of the plurality of cavities, the heat sink comprising a lower part of a casing of the portable incubator apparatus, wherein the plurality of cavities are disposed in the portable incubator apparatus in a two-dimensional array and each row of the array is associated with two Peltier heat pumps, and wherein the two Peltier heat pumps on each row are independent from the two Peltier heat pumps on adjacent rows to provide independent control of temperatures of analyte contained in cavities in each row.

2. A portable incubator apparatus as claimed in claim 1, further comprising a power supply which provides electrical power to allow independent operation of the portable incubator apparatus.

3. A portable incubator apparatus as claimed in claim 1, further comprising at least one light source configured to illuminate analyte contained in at least one of the plurality of cavities.

4. A portable incubator apparatus as claimed in claim 1, configured for use in one or more of the following processes; biological crystallisation, non-biological crystallisation, enzyme kinetics, fermentation, polymer science, stem cell storage, polymerase chain reaction, polymer science and similar DNA related processes.

5. Portable incubator apparatus as claimed in claim 1, wherein the portable incubator apparatus is configured to maintain a first group of cavities at a first temperature and a second group of cavities at a second temperature different from the first.

6. Portable incubator apparatus as claimed in claim 1, wherein the portable incubator apparatus is configured to create a first temperature gradient across a first group of cavities and a second temperature gradient across a second group of cavities, said first and second temperature gradients being independently controlled.

7. A portable incubator apparatus as claimed in claim 1, wherein the heat sink has a footprint in accordance with ANSI/SBS 1-2004.

8. A portable incubator apparatus as claimed in claim 1, wherein the portable incubator apparatus comprises a temperature controller operable to control the temperatures of analyte contained in the plurality of cavities to be less than ambient temperature.

9. A portable incubator apparatus as claimed in claim 1, wherein the portable incubator apparatus is configured to control temperatures of analyte contained in the plurality of cavities to be between about 4° C. and about 35° C.

10. An SBS footprint portable incubator apparatus comprising: a plurality of cavities, each configured to receive an analyte to be incubated;

wherein the portable incubator apparatus is configured to control temperatures of analyte contained in the plurality of cavities independently of each other; and the portable incubator apparatus is further configured to maintain desired incubation conditions, independently of a supply of electrical power and external apparatus, while the portable incubator apparatus is moved from a first location to a second location, the portable incubator apparatus comprising at least one heat sink thermally coupled to at least one of the plurality of cavities, the heat sink comprising a lower part of a casing of the portable incubator apparatus and the heat sink having a footprint in accordance with ANSI/SBS 1-2004; wherein the plurality of cavities are disposed in the portable incubator apparatus in a two-dimensional array and each row of the array is associated with two Peltier heat pumps, and wherein the two Peltier heat pumps on each row are independent from the two Peltier heat pumps on adjacent rows to provide independent control of temperatures of analyte contained in cavities in each row.

11. A portable incubator apparatus as claimed in claim 10, wherein the portable incubator apparatus comprises a temperature controller operable to control the temperatures of analyte contained in the plurality of cavities to be less than ambient temperature.

12. A portable incubator apparatus as claimed in claim 10, wherein the portable incubator apparatus is configured to control temperatures of analyte contained in the plurality of cavities to be between about 4° C. and about 35° C.

13. A portable incubator apparatus as claimed in claim 10, further comprising a power supply which provides electrical power to allow independent operation of the portable incubator apparatus.

14. A portable incubator apparatus as claimed in claim 10, further comprising at least one light source configured to illuminate analyte contained in at least one of the plurality of cavities.

15. A portable incubator apparatus as claimed in claim 10, configured for use in one or more of the following processes; biological crystallisation, non-biological crystallisation, enzyme kinetics, fermentation, polymer science, stem cell storage, polymerase chain reaction, polymer science and similar DNA related processes.

16. Portable incubator apparatus as claimed in claim 10, wherein the portable incubator apparatus is configured to maintain a first group of cavities at a first temperature and a second group of cavities at a second temperature different from the first.

17. Portable incubator apparatus as claimed in claim 10, wherein the portable incubator apparatus is configured to create a first temperature gradient across a first group of cavities and a second temperature gradient across a second group of cavities, said first and second temperature gradients being independently controlled.

18. An SBS footprint portable incubator apparatus comprising: a plurality of cavities, each configured to receive an analyte to be incubated;

wherein the portable incubator apparatus is configured to control temperatures of analyte contained in the plurality of cavities independently of each other; and the portable incubator apparatus is further configured to maintain desired incubation conditions, independently of a supply of electrical power and external apparatus, while the portable incubator apparatus is moved from a first location to a second location, the portable incubator apparatus comprising at least one heat sink thermally coupled to at least one of the plurality of cavities, the heat sink comprising a lower part of a casing of the portable incubator apparatus and the heat sink having a footprint in accordance with ANSI/SBS 1-2004, wherein the plurality of cavities are disposed in the portable incubator apparatus in a two-dimensional array and each row of the array is associated with two Peltier heat pumps, and wherein the two Peltier heat pumps on each row are independent from the two Peltier heat pumps on adjacent rows to provide independent control of temperatures of analyte contained in cavities in each row, and wherein the portable incubator apparatus comprises a temperature controller operable to control the temperatures of analyte contained in the plurality of cavities to be less than ambient temperature.

19. A portable incubator apparatus as claimed in claim 18, wherein the portable incubator apparatus is configured to control temperatures of analyte contained in the plurality of cavities to be between about 4° C. and about 35° C.

* * * * *